United States Patent [19]

Kato et al.

[11] Patent Number: 4,595,178

[45] Date of Patent: Jun. 17, 1986

[54] LEG FOR VACUUM TANK FOR REFINING MOLTEN STEEL

[75] Inventors: Hitoshi Kato, Seto; Eiji Kawamoto, Tajimi, both of Japan

[73] Assignee: Tokyo Yogyo Kabushiki Kaisha, Tokyo, Japan

[21] Appl. No.: 687,634

[22] Filed: Dec. 31, 1984

[30] Foreign Application Priority Data

Feb. 2, 1984 [JP] Japan ..... 59-18070

[51] Int. Cl.[4] ..... C21C 7/10

[52] U.S. Cl. ..... 266/280; 266/208; 266/283

[58] Field of Search ..... 266/208, 209, 210, 211, 266/212, 280, 283, 285, 287

[56] References Cited

U.S. PATENT DOCUMENTS 3,353,809 11/1967 Snellman ..... 266/208

3,422,857 1/1969 Napora ..... 266/208

*Primary Examiner*—L. Dewayne Rutledge

*Assistant Examiner*—Robert L. McDowell

*Attorney, Agent, or Firm*—Frishauf, Holtz, Goodman & Woodward

[57] ABSTRACT

A leg is fitted through a joint material into each of a pair of vertical openings on a bottom wall of a vacuum tank for refining molten steel, for protecting the vertical openings from molten steel. The abovementioned leg has an annular inner wall formed by piling up through a joint material a plurality of magnesia-chrome fired radial bricks in a plurality of horizontal annular rows arranged one on the other so as to form an inner bore for passing molten steel therethrough. The leg also has an annular outer wall formed by piling up through a joint material a plurality of magnesia-chrome fired radial bricks in a plurality of horizontal rows arranged one on the other so as to cover substantially the entire outer surface of the annular inner wall. The inner surface of the annular outer wall is in contact with the outer surface of the annular inner wall through a joint material.

3 Claims, 5 Drawing Figures

PRIOR ART FIG. 1
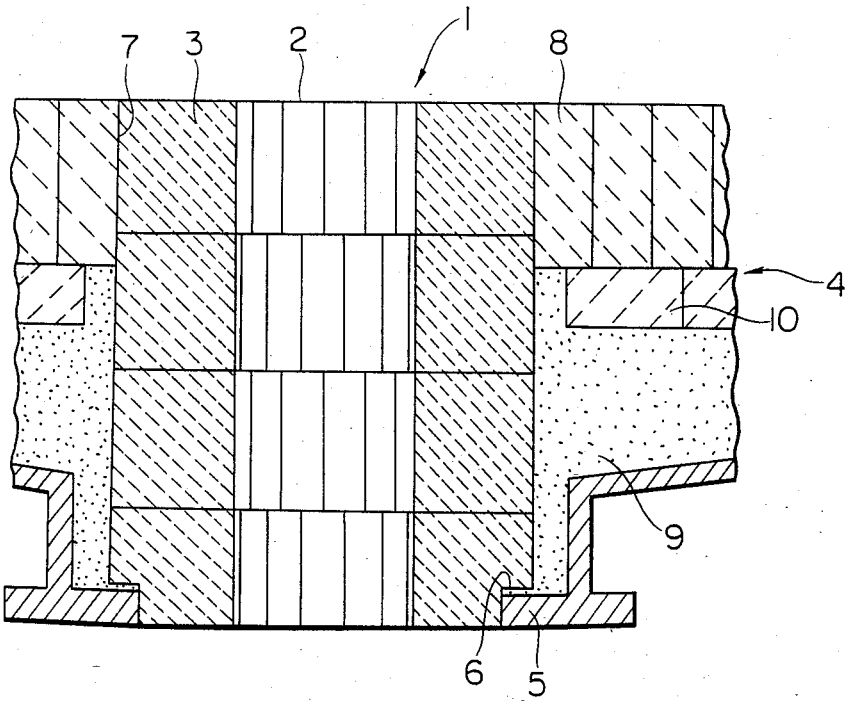
PRIOR ART FIG. 2
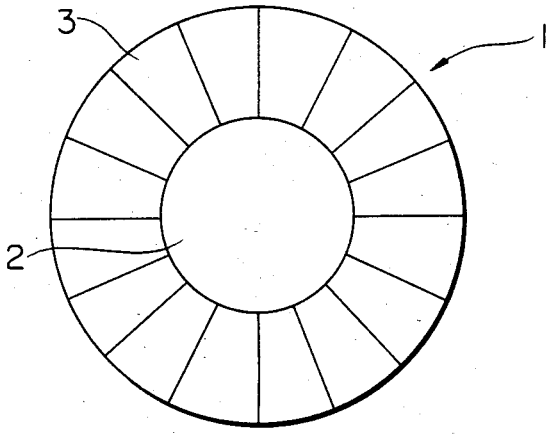

LEG FOR VACUUM TANK FOR REFINING MOLTEN STEEL

FIELD OF THE INVENTION

The present invention relates, in the RH-type vacuum-refining of molten steel, to a leg which is fitted through a joint material into each of a pair of vertical openings on a bottom wall of a vacuum tank for refining molten steel, for protecting the vertical openings from molten steel.

BACKGROUND OF THE INVENTION

As one of the vacuum-refining processes of molten steel, the RH-type vacuum-refining process is known, which comprises:

using a vacuum tank for refining molten steel, which tank includes a vacuum pump, a pair of vertical openings being provided on a bottom wall of said vacuum tank, a pair of legs having a respective inner bore for passing molten steel therethrough, each fitted into each of said vertical openings, for protecting said vertical openings from molten steel, and a pair of immersion tubes each of which is vertically connected to the lower end of each of said legs so as to project downwardly from the bottom wall of said vacuum tank;

immersing said pair of immersion tubes into molten steel received in a ladle arranged below said vacuum tank;

blowing an inert gas from one of said pair of immersion tubes while reducing the pressure in said vacuum tank by means of said vacuum pump to suck up molten steel received in said ladle, through the one of said immersion tubes and the one of said legs connected thereto, into said vacuum tank; and returning molten steel sucked up into said vacuum tank, through the other one of said legs and the other one of said immersion tubes connected thereto, into said ladle to circulate molten steel received into said ladle between said ladle and said tank;

thereby degassing, in said vacuum tank, molten steel received in said ladle to refine said molten steel.

In the above-mentioned RH-type vacuum-refining process of molten steel, each of the pair of legs for protecting each of the pair of vertical openings on the bottom wall of the vacuum tank from molten steel comprises an annular brick wall formed by piling up through a joint material a plurality of magnesia-chrome fired radial bricks in a plurality of horizontal annular rows arranged one on the other so as to form an inner bore for passing molten steel therethrough. The leg is fitted through a joint material into each of the pair of vertical openings on the bottom wall of the vacuum tank for refining molten steel.

The inner bore of the leg is susceptible to serious erosion because molten steel including an inert gas vigorously flows therethrough. The leg is therefore formed with the use of magnesia-chrome fired radial bricks excellent in erosion resistance against molten steel.

FIG. 1 is a schematic longitudinal sectional view illustrating a conventional leg for a vacuum tank used in the RH-type vacuum-refining of molten steel; and FIG. 2 is a schematic plan view illustrating the leg shown in FIG. 1. As shown in FIGS. 1 and 2, the conventional leg 1 comprises an annular brick wall formed by piling up zigzag, through a joint material of magnesia mortar, a plurality of magnesia-chrome fired radial bricks 3 in a plurality of horizontal annular rows arranged one on the other so as to form an inner bore 2 for passing molten steel therethrough. The lowermost row of the plurality of horizontal annular rows arranged one on the other which form the annular brick wall has an offset portion 6 for securing the leg 1 to a bottom wall 4 of the vacuum tank for refining molten steel by being hooked on a fitting 5 fixed to the bottom wall 4. The leg 1 is fitted through a joint material of magnesia mortar into each of a pair of vertical openings 7 of the bottom wall 4 with the offset portion 6 hooked on the fitting 5.

However, the above-mentioned conventional leg 1 has the following drawbacks. The magnesia-chrome fired radial bricks 3 which form the leg 1, while being excellent in erosion resistance against molten steel, have a high thermal expansion. As a result, each of the magnesia-chrome bricks 3 largely expands under the effect of the heat applied by molten steel passing through the inner bore 2 of the leg 1, tending to largely expand outwardly in the radial direction of the leg 1. The magnesia-chrome bricks 3 which form the uppermost row of the horizontal annular rows arranged one on the other, being in contact with bottom bricks 8 which form the upper portion of the bottom wall 4 of the vacuum tank, are inhibited from expanding. However, the magnesia-chrome bricks 3 which form rows other than the uppermost one, being in contact with a high-alumina castable layer 9 having a high thermal contraction which forms the middle and lower portions of the bottom wall 4, are not inhibited from expanding. As a result, horizontal and vertical joint materials between adjacent magnesia-chrome bricks 3 which form the leg 1 become loose, and erosion of the joint materials cannot be disregarded. In spite of the sufficient thickness of the magnesia-chrome bricks 3, therefore, the leg 1 becomes unusable after a relatively small number of vacuum-refining cycles of molten steel. In FIG. 1, bottom lining bricks 10 are provided under the bottom bricks 8.

Under such circumstances, there is a strong demand for development of a leg for a vacuum tank for refining molten steel, which, when vacuum-refining molten steel by the RH-type vacuum-refining process, is capable of withstanding the use for many cycles of vacuum-refining. A leg for a vacuum tank for refining molten steel provided with such a property has, however, not as yet been proposed.

SUMMARY OF THE INVENTION

An object of the present invention is therefore to provide a leg for a vacuum tank for refining molten steel, which, when vacuum-refining molten steel by the RH-type vacuum-refining process, is capable of withstanding the use for many cycles of vacuum-refining;

A principal object of the present invention is to provide a leg for a vacuum tank for refining molten steel, which, when vacuum-refining molten steel by the RH-type vacuum-refining process, is capable of withstanding the use for many cycles of vacuum-refining by preventing loosening of a joint material in an annular brick wall formed by piling with the joint material a plurality of magnesia-chrome fired radial bricks in a plurality of horizontal annular rows arranged one on the other so as to form an inner bore for passing molten steel therethrough.

In accordance with one of the features of the present invention, there is provided a leg which is fitted through a joint material into each of a pair of vertical openings in a bottom wall of a vacuum tank for refining molten steel, for protecting said vertical openings from molten steel, said leg comprising an annular brick wall formed by piling up through a joint material a plurality of magnesia-chrome fired radial bricks in a plurality of horizontal annular rows arranged one on the other so as to form an inner bore for passing molten steel therethrough;

wherein:

said annular brick wall comprises an annular inner wall forming said inner bore and an annular outer wall covering substantially the entire outer surface of said annular inner wall;

said annular inner wall is formed by piling up through a joint material a plurality of magnesia-chrome fired radial bricks in a plurality of horizontal annular rows arranged one on the other so as to form said inner bore; and said annular outer wall is formed by piling up through a joint material a plurality of magnesia-chrome fired radial bricks in a plurality of horizontal rows arranged one on the other so as to cover substantially the entire outer surface of said annular inner wall, and the inner surface of said annular outer wall is in contact with the outer surface of said annular inner wall through a joint material.

BRIEF DESCRIPTION OF THE DRAWINGS

FIG. 1 is a schematic longitudinal sectional view illustrating a conventional leg for a vacuum tank used in the RH-type vacuum-refining of molten steel;

FIG. 2 is a schematic plan view illustrating the conventional leg shown in FIG. 1;

DETAILED DESCRIPTION OF THE PREFERRED EMBODIMENTS

From the above-mentioned point of view, extensive studies were carried out to develop a leg for a vacuum tank for refining molten steel, which, when vacuum-refining molten steel by the RH-type vacuum-refining process, is capable of withstanding use for many cycles of vacuum-refining, by preventing loosening of a joint material in an annular brick wall formed by piling up through a joint material a plurality of magnesia-chrome fired radial bricks in a plurality of horizontal annular rows arranged one on the other so as to form an inner bore for passing molten steel therethrough.

As a result, findings were obtained the following finding: it is possible to obtain a leg for a vacuum tank for refining molten steel, which is capable of preventing loosening of a joint material in an annular brick wall which forms the leg, and thus withstanding the use for many cycles of vacuum-refining, by constructing the above-mentioned annular brick wall with an annular inner wall formed by piling up through a joint material a plurality of magnesia-chrome fired radial bricks in a plurality of horizontal annular rows arranged one on the other so as to form an inner bore for passing molten steel therethrough, and an annular outer wall formed by piling up through a joint material a plurality of magnesia-chrome fired radial bricks in a plurality of horizontal rows arranged one on the other so as to cover substantially the entire outer surface of the annular inner wall, and by causing the inner surface of the annular outer wall to be in contact with the outer surface of the annular inner wall through a joint material.

The reason for constructing the annular brick wall forming the leg with the annular inner wall forming the inner bore and the annular outer wall, the inner surface thereof being in contact with the outer surface of the annular inner wall through the joint material, is as follows. The heat applied to the leg by molten steel passing through the inner bore thereof is transmitted from the inner surface toward the outer surface of the annular brick wall forming the leg. When the annular brick wall comprises an annular inner wall and an annular outer wall, the joint material between the inner wall and the outer wall makes it difficult for the heat to be transmitted, thus permitting inhibition of the temperature of the outer wall to below about 600° C. The annular outer wall formed by piling up the plurality of magnesia-chrome fired radial bricks through a joint material of magnesia mortar, which shows a high adhesive strength within the temperature range of from about 300° C. to about 600° C., would be a very firm ring. Outward expansion of the magnesia-chrome fired radial bricks forming the annular inner wall is consequently inhibited by the annular outer wall, thus preventing the joint material of the inner wall from loosening. It is thus possible to obtain a leg in which loosening of the joint material is prevented as a whole.

Figure 3:
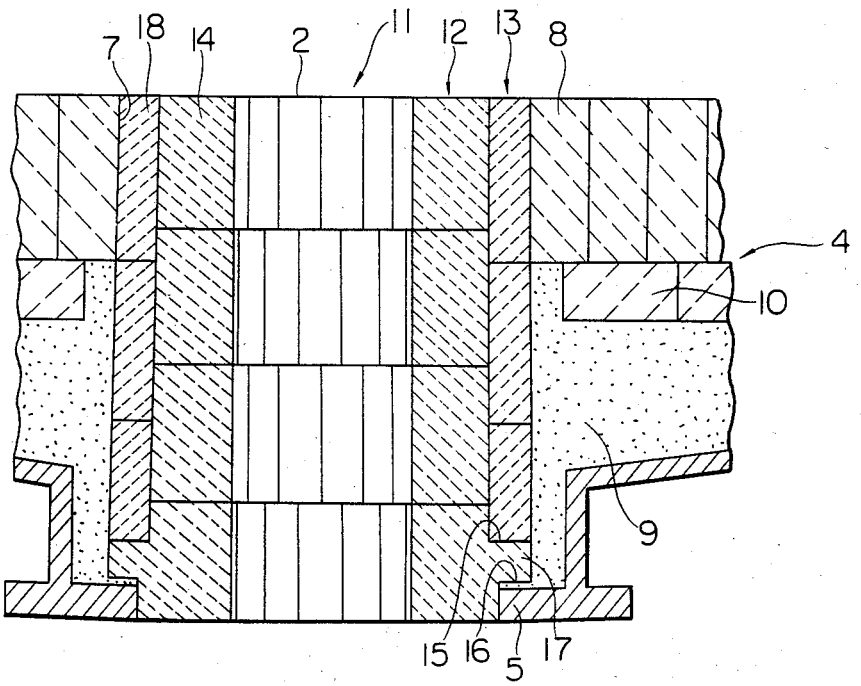
FIG. 3 is a schematic longitudinal sectional view illustrating an embodiment of a leg of the present invention for a vacuum tank used in the RH-type vacuum-refining of molten steel.
Figure 4:
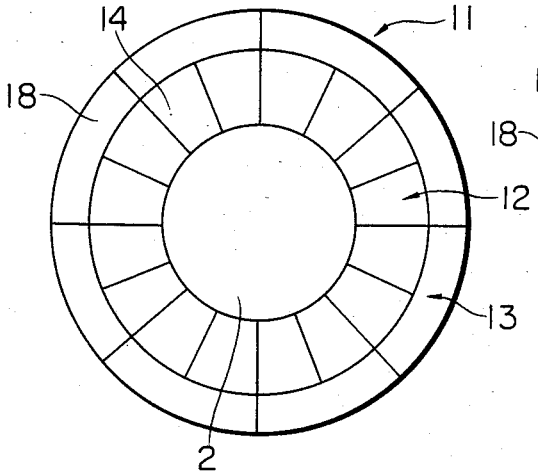
FIG. 4 is a schematic plan view illustrating the leg of the present invention shown in FIG. 3.

FIG. 3 is a schematic longitudinal sectional view illustrating an embodiment of a leg of the present invention for a vacuum tank used in the RH-type vacuum-refining of molten steel, and FIG. 4 is a schematic plan view illustrating the leg of the present invention shown in FIG. 3. As shown in FIGS. 3 and 4, a leg 11 of the present invention comprises an annular inner wall 12 forming an inner bore 2 for passing molten steel therethrough and an annular outer wall 13 covering substantially the entire outer surface of the annular inner wall 12, and is fitted through a joint material of magnesia mortar into each of a pair of vertical openings 7 on a bottom wall 4 of a vacuum tank for refining molten steel.

The annular inner wall 12 is formed by piling up zigzag through a joint material of magnesia mortar a plurality of magnesia-chrome fired radial bricks 14 in a plurality of horizontal annular rows arranged one on the other so as to form the inner bore 2 for passing molten steel therethrough. The lowermost row of the plurality of horizontal annular rows arranged one on the other which form the annular inner wall 12, is provided with a projection 17 which forms an offset portion 15 for supporting the annular outer wall 13, and another offset portion 16 for securing the leg 11 in each of the pair of vertical openings 7 on the bottom wall 4 of the vacuum tank for refining molten steel by being hooked on a fitting 5 fixed to the bottom wall 4.

The annular outer wall 13 is formed on the offset portion 15 of the annular inner wall 12 by piling up zigzag through a joint material of magnesia mortar a plurality of magnesia-chrome fired radial bricks 18 in a plurality of horizontal annular rows, so as to cover the entire outer surface of the portion of the annular inner wall 12 above the offset portion 15 of the annular inner wall 12. The inner surface of the annular outer wall 13 is in contact with the outer surface of the annular inner wall 12 through a joint material of magnesia mortar. The magnesia-chrome bricks 18 which form the the annular outer wall 13 preferably have two side dimensions longer than those of the magnesia-chrome bricks 14 which form the annular inner wall 12 with a view to achieving a higher mechanical strength of the annular outer wall 13. In order to improve erosion resistance of the horizontal joint material of the leg 11, the horizontal joint material between the magnesia-chrome bricks 18 arranged one on the other forming the annular outer wall 13 preferably is out of line with the horizontal joint material between the magnesia-chrome bricks 14 arranged one on the other forming the annular inner wall 12. In FIG. 3, bottom bricks 8 form the upper portion of the bottom wall 4 of the vacuum tank for refining molten steel, a high-alumina castable layer 9 having a high thermal contraction forms the middle and lower portions of the bottom wall 4, and bottom lining bricks 10 are provided under the bottom bricks 8.

Figure 5:
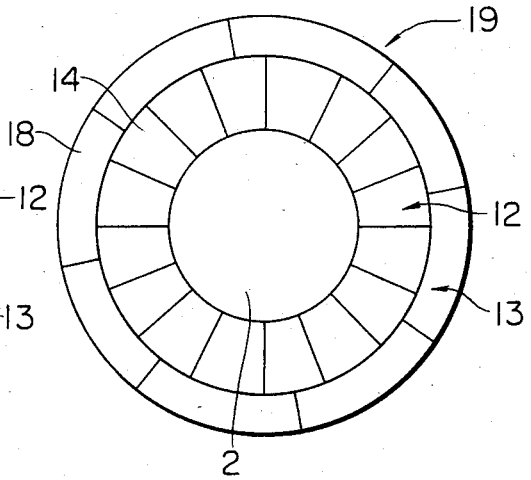
FIG. 5 is a schematic plan view illustrating another embodiment of a leg of the present invention for a vacuum tank used in the RH-type vacuum-refining of molten steel.

FIG. 5 is a schematic plan view illustrating another embodiment of a leg of the present invention for a vacuum tank used in the RH-type vacuum-refining of molten steel. In a leg 19 of this embodiment, as shown in FIG. 5, the vertical joint material between the magnesia-chrome bricks 18 arranged side by side forming the annular outer wall 13 is out of line with the vertical joint material between the magnesia-chrome bricks 14 arranged side by side forming the annular inner wall 12, in order to improve erosion resistance of the vertical joint material. The other compositions of the leg 19 shown in FIG. 5 are the same as those of the leg 11 shown in FIGS. 3 and 4.

In the leg of the present invention, which has the structure as described above, outward expansion of the magnesia-chrome bricks 14 forming the annular inner wall 12 is inhibited by the annular outer wall 13. Therefore, even when the magnesia-chrome bricks 18 forming rows other than the uppermost one of the plurality of horizontal annular rows arranged one on the other which form the annular outer wall 13 are in contact with the high-alumina castable layer 9 having a high thermal contraction which forms the middle and lower portions of the bottom wall 4 of the vacuum tank for refining molten steel, loosening of the joint material experienced in the conventional leg 1 never occurs in the leg of the present invention.

Now, the leg of the present invention will be described more in detail by means of an example.

EXAMPLE

A leg 11 of the present invention as described above with reference to FIGS. 3 and 4, having a height of 850 mm, an inside diameter of 500 mm, and an outside diameter of 900 mm was fitted into each of the pair of vertical openings 7 in the bottom wall 4 of the vacuum tank for refining molten steel, connected with each of the pair of immersion tubes, and molten steel was refined by the Rh-type vacuum-refining process, to investigate the service life of the leg 11 as expressed by the number of cycles of vacuum-refining. For the comparison purposes, a conventional leg 1 as described above with reference to FIGS. 1 and 2, having a height of 850 mm, an inside diameter of 500 mm, and an outside diameter of 900 mm was fitted into each of the pair of vertical openings 7 of the bottom wall 4 of the vacuum tank for refining molten steel, connected with each of the pair of immersion tubes, and molten steel was refined by the RH-type vacuum-refining process, to investigate the service life of the leg 1 as expressed by the number of cycles of vacuum-refining.

The leg 11 of the present invention in the Example was prepared, as shown in FIGS. 3 and 4, by forming the annular inner wall 12 by piling up zigzag through the joint material of magnesia mortar, sixty-four magnesia-chrome fired radial bricks 14 in four horizontal annular rows arranged one on the other each with sixteen bricks so as to form the inner bore 2 for passing molten steel therethrough; and by forming the annular outer wall 13 by piling up zigzag through the joint material of magnesia mortar, twenty-four magnesia-chrome fired radial bricks 18 in three horizontal annular rows arranged one on the other each with eight bricks so as to cover substantially the entire outer surface of the annular inner wall 12 through the joint material of magnesia mortar.

The conventional leg 1 for comparison purposes was prepared, as shown in FIGS. 1 and 2, by piling up zigzag through the joint material of magnesia mortar sixty-four magnesia-chrome fired radial bricks 3 in four horizontal annular rows arranged one on the other each with sixteen bricks so as to form the inner bore 2 for passing molten steel therethrough.

Molten steel received in a 250-ton ladle was vacuum-refined under the following conditions:

(1) Pressure in the vacuum tank: 0.2 Torr,
(2) Amount of blown argon gas: 1,000 Nl/minute,
(3) Flow rate of molten steel: 80 tons/minute,
(4) Amount of molten steel refined in a cycle: 250 tons, and
(5) Refining period per cycle: 20 minutes.

As a result, the leg 11 of the present invention withstood use for 600 cycles of vacuum-refining because no loosening of the joint material occurred, resulting in only a slight erosion of the joint material. The conventional leg 1 became, however, unusable with 450 cycles of vacuum-refining because of the occurrence of serious loosening of the joint material, leading to a marked erosion of the joint material.

According to the present invention, as described above in detail, it is possible to obtain a leg for a vacuum tank for refining molten steel, in which, when vacuum-refining molten steel by the RH-type vacuum-refining process, loosening of the joint material between the magnesia-chrome fired radial bricks which form the leg is largely reduced, and of which the service life is extended to about 1.3 times as long as that of the conventional leg, thus providing industrially useful effects.

What is claimed is:

1. A leg of the kind which is fitted through a joint material into each of a pair of vertical openings on a bottom wall of a vacuum tank for refining molten steel, for protecting the walls of said vertical openings from molten steel, said leg including an annular brick wall formed by piling with a joint material a plurality of magnesia-chrome fired radial bricks in a plurality of horizontal annular rows arranged one on the other so as to form an inner bore for passing the molten steel therethrough; wherein said leg comprises:

an annular brick wall formed of an annular inner wall forming said inner bore and an annular outer wall covering substantially the entire outer surface of said annular inner wall;

said annular inner wall is formed of a plurality of magnesia-chrome fired radial bricks piled with a joint material in a plurality of horizontal annular rows arranged one on the other so as to form said inner bore; and said annular outer wall is formed of a plurality of magnesia-chrome fired radial bricks piled with a joint material in a plurality of horizontal rows arranged one on the other so as to cover substantially the entire outer surface of said annular inner wall, and the inner surface of said annular outer wall is in contact with the outer surface of said annular inner wall through the joint material; and wherein said annular outer wall substantially inhibits radially outward expansion of said plurality of magnesia-chrome fired radial bricks forming said annular inner wall, the joint material of said annular inner wall being prevented from loosening over a number of refining cycles of the vacuum tank.

2. The leg as claimed in claim 1, wherein:

the lowermost row of said plurality of horizontal annular rows arranged one on the other, which form said annular inner wall, define an offset portion for supporting said annular outer wall and another offset portion for securing said leg in each of said pair of vertical openings on said bottom wall of said vacuum tank by being hooked on a fitting fixed to said bottom wall.

3. The leg as claimed in claim 1, wherein the joint material comprises magnesia mortar.

* * * * *